US009830894B1

(12) United States Patent
Ma et al.

(10) Patent No.: US 9,830,894 B1
(45) Date of Patent: Nov. 28, 2017

(54) SYSTEMS AND METHODS FOR PLAYING VIRTUAL MUSIC INSTRUMENT THROUGH TRACKING OF FINGERS WITH CODED LIGHT

(71) Applicant: FUJI XEROX CO., LTD., Tokyo (JP)

(72) Inventors: Shang Ma, Irvine, CA (US); Qiong Liu, Cupertino, CA (US)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 15/164,548

(22) Filed: May 25, 2016

(51) Int. Cl.
*G10H 3/06* (2006.01)
*G10H 1/34* (2006.01)
*G10H 3/00* (2006.01)

(52) U.S. Cl.
CPC ..... *G10H 1/34* (2013.01); *G10H 3/00* (2013.01); *G10H 2220/041* (2013.01); *G10H 2220/201* (2013.01); *G10H 2220/326* (2013.01); *G10H 2220/411* (2013.01); *G10H 2230/065* (2013.01); *G10H 2230/351* (2013.01)

(58) Field of Classification Search
CPC .... G06F 3/017; G06F 3/0488; G06F 3/04845; G06F 3/014; G06F 21/32; G06F 2203/0331; G06F 3/0426; G06F 3/04895; G06T 1/20; G06T 7/20; G02B 2027/0187; G10G 1/00; G10G 1/02; G10G 1/04; G10C 3/12; G10D 17/00
See application file for complete search history.

(56) References Cited

U.S. PATENT DOCUMENTS 7,084,859 B1 * 8/2006 Pryor ..... G01C 21/3664 345/156
8,179,604 B1 * 5/2012 Prada Gomez .... G02B 27/0093 345/8
9,418,637 B1 * 8/2016 Akbari ..... G10G 1/04
2001/0029829 A1 * 10/2001 Moe ..... G09B 15/08 84/478

(Continued)

OTHER PUBLICATIONS

KolesniK, P. 2004. Conducting gesture recognition, analysis and performance system. Master Thesis. McGill University.

(Continued)

*Primary Examiner* — Marlon Fletcher
(74) *Attorney, Agent, or Firm* — TransPacific Law Group; Pavel I. Pogodin, Esq.

(57) ABSTRACT

Finger-tracking systems and methods for virtual instruments playback. The described system tracks the position of user's ten fingers on a projection surface and can be used to play virtual instruments such as virtual piano, drums, and bells. The system tracks the movement of user's ten fingers while keeping them free of encumbrance or excessive postural constraints. More specifically, in one or more embodiments, a coded light based projector is used to send out location signal onto a flat surface, and ten light sensors are mounted on user's fingers to receive these signals and locate user's fingers. Based on their locations and relative distance to a fixed point, a printed music instrument can be used for virtual instrument music playback. With the described tracking system, various embodiments of virtual music instruments may be implemented, including a system and method for virtual piano playing as well as virtual Chinese bell playing on printed keyboard and printed Chinese bell set.

20 Claims, 7 Drawing Sheets

(56) References Cited

U.S. PATENT DOCUMENTS

| | | | | |
|---|---|---|---|---|
| 2004/0244570 | A1* | 12/2004 | Ando | G10H 1/0016 84/744 |
| 2009/0303176 | A1* | 12/2009 | Chen | G06F 3/017 345/156 |
| 2011/0007035 | A1* | 1/2011 | Shai | G06F 3/014 345/179 |
| 2011/0043702 | A1* | 2/2011 | Hawkins | G06F 3/011 348/584 |
| 2011/0119640 | A1* | 5/2011 | Berkes | G06F 3/011 715/863 |
| 2011/0210931 | A1* | 9/2011 | Shai | G06F 3/014 345/173 |
| 2012/0262366 | A1* | 10/2012 | Zhu | G06F 3/017 345/156 |
| 2014/0267029 | A1* | 9/2014 | Govil | G06K 9/00355 345/157 |
| 2015/0084884 | A1* | 3/2015 | Cherradi El Fadili | G06F 3/041 345/173 |
| 2016/0196763 | A1* | 7/2016 | Ng | G09B 15/023 84/478 |

OTHER PUBLICATIONS

Ilmonen, T., and Takala, T. 1999. Conductor following with artificial neural networks.

Varni, G, Inter. sonification of synchronisation of motoric behaviour in social active listening to music with mobile devices, J. on Multimodal User Interfaces 5(3-4) 157-173.

Dillon, H, Virluaf orchestra: An immersive computer game for fun and education. In Proceedings of the 2006 international conference on Game research and development. 215-218.

* cited by examiner

500

SYSTEMS AND METHODS FOR PLAYING VIRTUAL MUSIC INSTRUMENT THROUGH TRACKING OF FINGERS WITH CODED LIGHT

BACKGROUND OF THE INVENTION

Technical Field

The disclosed embodiments relate in general to music interface design and, more specifically, to systems and methods for playing virtual music instrument through tracking of fingers with coded light.

Description of the Related Art

Many sensing technologies have been explored for music interface design. Visual tracking approach where the camera is the only or the main sensor is generally considered to be a dominating technique, which covers a wide field of applications. This method enables many different objects or body parts to be tracked independently without other special equipment, see, for example, Kolesnik, P. 2004. Conducting gesture recognition, analysis and performance system. Master Thesis. McGill University. Main disadvantages of this technique are the significant power consumption and required high storage capacity, which may be challenging to implement in practice.

Other sensor-based systems can also provide a greater range of data and make very expressive musical controllers. For example, magnetic tracking described in Ilmonen, T., and Takala, T., 1999, Conductor following with artificial neural networks, accelerometer tracking described in Varni, G., Dubus, G., Oksanen, S., Volpe, G., Fabiani, M., Bresin, R., Kleimola, J., Valimaki, V., and Camurri, A. 2012. Interactive sonification of synchronisation of motoric behaviour in social active listening to music with mobile devices. Journal on Multimodal User Interfaces, 5(3-4), 157-173, and gyroscope tracking described in Dillon, R., Wong, G., and Ang, R. 2006. Virtual orchestra: An immersive computer game for fun and education. In Proceedings of the 2006 international conference on Game research and development, 215-218, have all been explored in previous studies. However, most of them are susceptible to a fair amount of unpredictable noise either from the sensing system itself or the surrounding environment.

In view of the above and other shortcomings of the conventional tracking technology, new and improved systems and methods for finger tracking are needed that could be used in music interface designs for enabling users to play virtual music instruments.

SUMMARY OF THE INVENTION

The embodiments described herein are directed to systems and methods that substantially obviate one or more of the above and other problems associated with the conventional object tracking technology.

In accordance with one aspect of the embodiments described herein, there is provided a finger-tracking system incorporating: a projector configured to project a temporal projector light signal, wherein the temporal projector light signal is encoded, for each pixel of the projector, with an information segment comprising the pixel coordinates of the each pixel of the projector; a plurality of light sensors, each of the plurality of light sensors being attached to a finger of a user, wherein each of the plurality of light sensors is configured to detect the temporal projector light signal and generate a sensor signal; and a processing unit operatively coupled to each of the plurality of light sensors and configured to receive the sensor signal from each of the plurality of light sensors, to determine a location information of each finger of the user and to issue a command based on the detected location of at least one finger of the user.

In one or more embodiments, the processing unit determines the location information of each finger of the user by identifying a projector pixel corresponding to the sensor signal from a light sensor attached to the corresponding finger of the user.

In one or more embodiments, the issued command causes a sound or a musical note to be synthesized.

In one or more embodiments, the location information of each finger of the user is determined in relation to an image of a piano keyboard comprising a plurality of piano keys.

In one or more embodiments, the processing unit uses the location information of each finger of the user to determine which piano key of the plurality of piano keys has been pressed.

In one or more embodiments, the processing unit causes a sound or a musical note corresponding to pressed piano key to be synthesized.

In one or more embodiments, the processing unit causes a sequence of pressed piano keys to be recorded.

In one or more embodiments, the recorded sequence of pressed piano keys is compared with a reference sequence to determine a difference and a feedback to the user is generated based on the determined difference.

In one or more embodiments, the location information of each finger of the user is determined in relation to an image of a plurality of Chinese bells.

In one or more embodiments, the processing unit uses the location information of each finger of the user to determine which bell of the plurality of Chinese bells has been struck.

In one or more embodiments, the processing unit causes a sound or a musical note corresponding to the struck bell to be synthesized.

In one or more embodiments, the temporal projector light signal projected by the project comprises a plurality of sequential light pulses encoding pixel coordinates of the each pixel of the projector.

In one or more embodiments, the finger-tracking system further incorporates a computer system including a display unit and operatively coupled with the processing unit and configured to receive from the processing unit the determined location information of each finger of the user and to display the received location information of each finger of the user on the display unit.

In one or more embodiments, the location information of each finger of the user is displayed on the display unit in a different color.

In one or more embodiments, the projector is a DLP projector.

In accordance with another aspect of the embodiments described herein, there is provided a method for tracking fingers of a user, the method involving: using a projector to project a temporal projector light signal, wherein the temporal projector light signal is encoded, for each pixel of the projector, with an information segment comprising the pixel coordinates of the each pixel of the projector; detecting the temporal projector light signal using a plurality of light sensors, each of the plurality of light sensors being attached to a finger of a user, wherein each of the plurality of light sensors is configured to detect the temporal projector light signal and generate a sensor signal; and using a processing unit operatively coupled to each of the plurality of light sensors to receive the sensor signal from each of the plurality of light sensors, to determine a location information of each finger of the user and to issue a command based on the detected location of at least one finger of the user.

In one or more embodiments, the processing unit determines the location information of each finger of the user by identifying a projector pixel corresponding to the sensor signal from a light sensor attached to the corresponding finger of the user.

In one or more embodiments, the issued command causes a sound or a musical note to be synthesized.

In one or more embodiments, the location information of each finger of the user is determined in relation to an image of a piano keyboard comprising a plurality of piano keys.

In one or more embodiments, the processing unit uses the location information of each finger of the user to determine which piano key of the plurality of piano keys has been pressed.

In accordance with yet another aspect of the embodiments described herein, there is provided a computer-readable medium embodying a set of instructions implementing a method for tracking fingers of a user, the method involving: using a projector to project a temporal projector light signal, wherein the temporal projector light signal is encoded, for each pixel of the projector, with an information segment comprising the pixel coordinates of the each pixel of the projector; detecting the temporal projector light signal using a plurality of light sensors, each of the plurality of light sensors being attached to a finger of a user, wherein each of the plurality of light sensors is configured to detect the temporal projector light signal and generate a sensor signal; and using a processing unit operatively coupled to each of the plurality of light sensors to receive the sensor signal from each of the plurality of light sensors, to determine a location information of each finger of the user and to issue a command based on the detected location of at least one finger of the user.

Additional aspects related to the invention will be set forth in part in the description which follows, and in part will be obvious from the description, or may be learned by practice of the invention. Aspects of the invention may be realized and attained by means of the elements and combinations of various elements and aspects particularly pointed out in the following detailed description and the appended claims.

It is to be understood that both the foregoing and the following descriptions are exemplary and explanatory only and are not intended to limit the claimed invention or application thereof in any manner whatsoever.

BRIEF DESCRIPTION OF THE DRAWINGS

The accompanying drawings, which are incorporated in and constitute a part of this specification exemplify the embodiments of the present invention and, together with the description, serve to explain and illustrate principles of the inventive technique. Specifically.

DETAILED DESCRIPTION

In the following detailed description, reference will be made to the accompanying drawing(s), in which identical functional elements are designated with like numerals. The aforementioned accompanying drawings show by way of illustration, and not by way of limitation, specific embodiments and implementations consistent with principles of the present invention. These implementations are described in sufficient detail to enable those skilled in the art to practice the invention and it is to be understood that other implementations may be utilized and that structural changes and/or substitutions of various elements may be made without departing from the scope and spirit of present invention. The following detailed description is, therefore, not to be construed in a limited sense. Additionally, the various embodiments of the invention as described may be implemented in the form of a software running on a general purpose computer, in the form of a specialized hardware, or combination of software and hardware.

Highly accurate and responsive finger tracking system may help people to follow music performers' fingers or baton movements, from which researchers can extract helpful skills of beautiful melodies and use them to guide instrument design, sound effect presentations, and music pedagogy.

In accordance with one aspect of the embodiments described herein, there are provided finger-tracking systems and methods for virtual instruments playback. In one or more embodiments, the described system tracks the position of user's ten fingers on a projection surface and can be used to play virtual instruments such as virtual piano, drums, and bells. In one or more embodiments, the system tracks the movement of user's ten fingers while keeping them free of encumbrance or excessive postural constraints. More specifically, in one or more embodiments, a coded light based projector is used to send out location signal onto a flat surface, and ten light sensors are mounted on user's fingers to receive these signals and locate user's fingers. Based on their locations and relative distance to a fixed point, a printed music instrument can be used for virtual instrument music playback. With the described tracking system, various embodiments of virtual music instruments may be implemented, including a system and method for virtual piano playing as well as virtual Chinese bell playing on printed keyboard and printed Chinese bell set.

Figure 1:
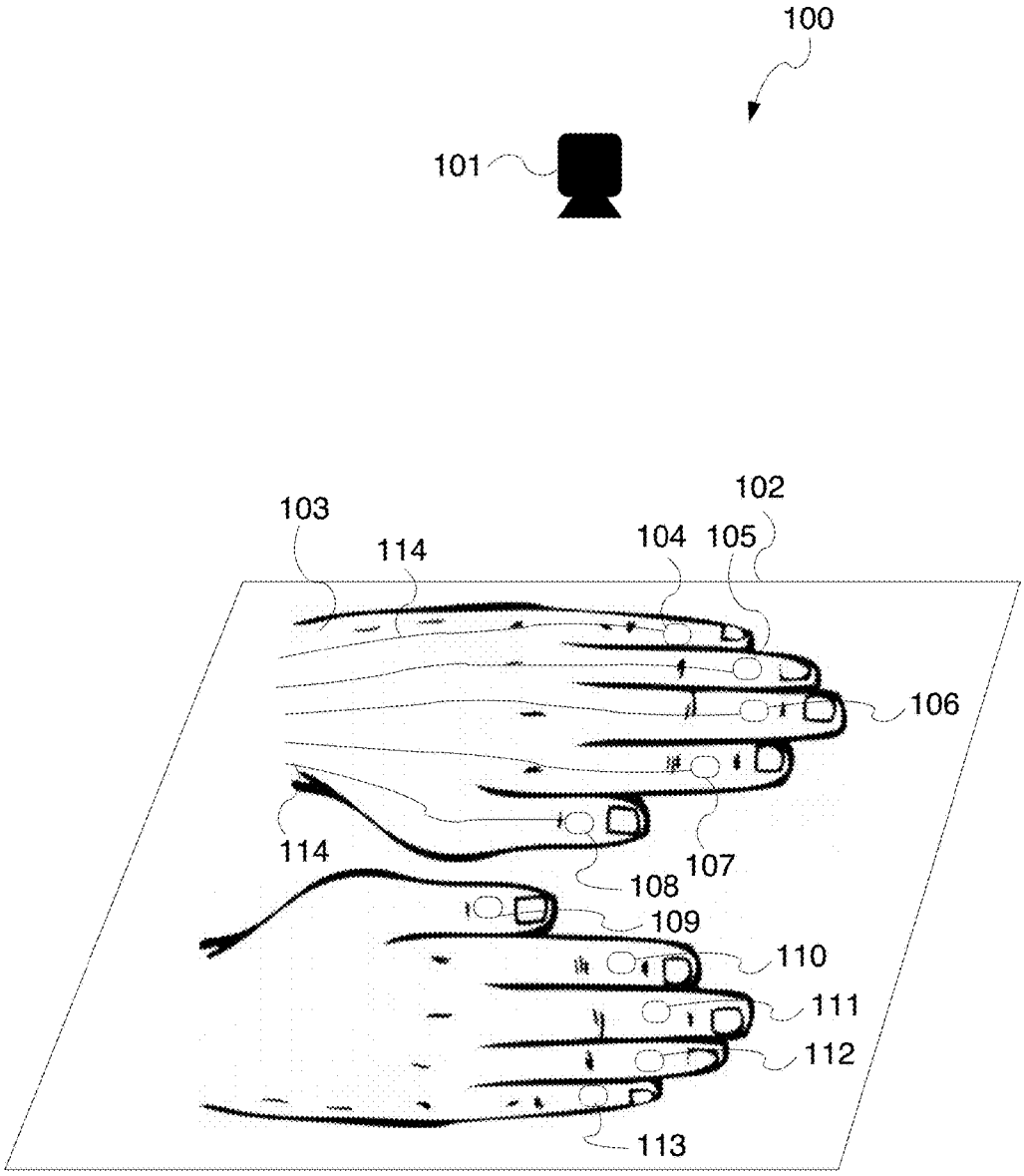
FIG. 1 illustrates an exemplary embodiment of a finger-tracking system for virtual instruments playback.

An exemplary embodiment of a finger-tracking system 100 for virtual instruments playback is illustrated in FIG. 1. The finger-tracking system 100 tracks the position of each of user's ten fingers on a projection surface and can be used to play virtual instruments such as virtual piano, drums, and bells. In one embodiment, the finger-tracking system 100 incorporates a projector 101 that is used to send out encoded light signal onto a flat surface, such as an office table 102 as shown in the FIG. 1. A user 103 who is sitting at the table 102 wears ten light sensors 104-113, one on each finger. In one embodiment, the light sensors 104-113 are luminosity sensors, such as photodiodes or phototransistors and are substantially small, such as 4.06 mm*3.04 mm, hence they can fit on a finger of the user 103. As would be appreciated by persons of ordinary skill in the art, the light sensors 104-113 may be of any other now known or later developed type of light sensor, capable of detecting the light pulse sequences generated by the projector 101. In various embodiments, the light sensors 104-113 may be secured to the user's fingers using bands or gloves.

Once the finger-tracking system 100 is powered on, all the light sensors 104-113 will receive position signal from the projector 101. Because the correspondence between the received light code and its position in the projection area are predefined, the finger-tracking system 100 is capable of restoring the positions of each of user's fingers by decoding the code represented by a sequence of projector light pulses from all ten light sensors 104-113. In one implementation, a specially programmed microcontroller is provided to decode the 10-channel data stream from the light sensors 104-113 and the final output is sent to a data visualization application running on a desktop computer. Wires 114 may be used to carry sensor signals from the respective sensors to the aforesaid microcontroller.

Figure 2A:
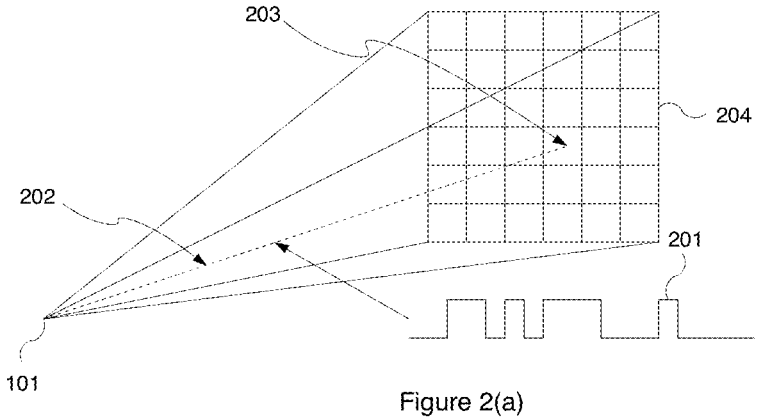
FIGS. 2(*a*) and 2(*b*) illustrate two temporal coded light signals produced by the projector.
Figure 2B:
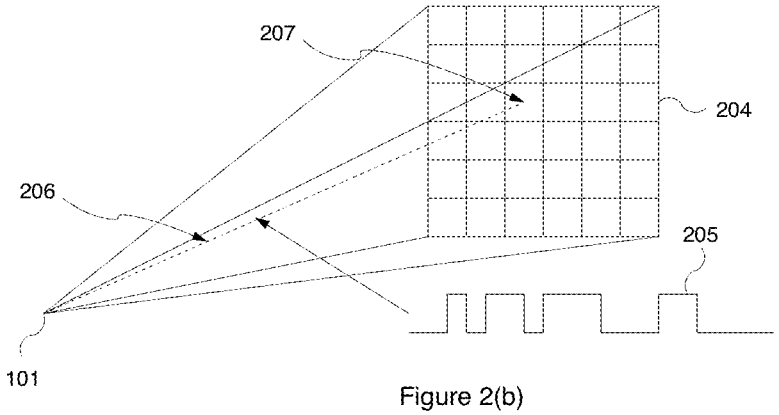

FIGS. 2(*a*) and 2(*b*) illustrate two temporal coded light signals 201 and 205 produced by the projector 101. In one embodiment, the projector 101 is a DLP projector, well known to persons of ordinary skill in the art. The temporal light signals 201 and 205 correspond to two different pixels 203 and 207 of the projector 101. The temporal light signal 201 propagating in the direction 202 is encoded with unique position information of the first projector pixel 203 using a corresponding first unique sequence of temporal light pulses. On the other hand, the temporal light signal 205 propagating in the direction 206 is encoded with unique position information of the second projector pixel 207 using a corresponding second unique sequence of temporal light pulses. In FIGS. 2(*a*) and 2(*b*) the projector pixels 203 and 207 are illustrated by their corresponding projections and on an imaginary projection surface 204. The aforesaid first and second sequences of light pulses are different and carry information about the respective projector pixel.

Figure 3:
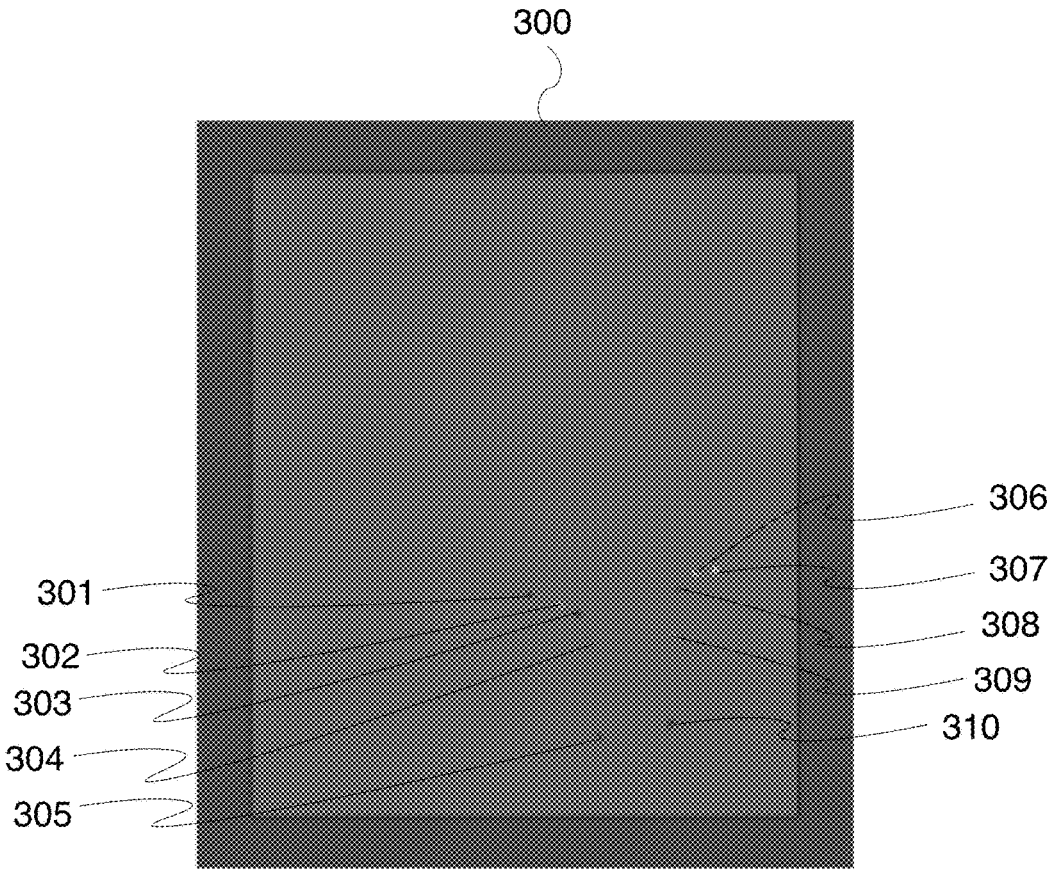
FIG. 3 illustrates an exemplary embodiment of a graphical user interface of the visualization application running on a desktop computer.

FIG. 3 illustrates an exemplary embodiment of a graphical user interface of the visualization application running on a desktop computer. As shown in FIG. 3, the aforesaid user interface displays the locations 301-310 of user's 103 ten fingers, which may be represented in different colors in the aforesaid graphical user interface of the visualization application running on a desktop computer.

Figure 4:
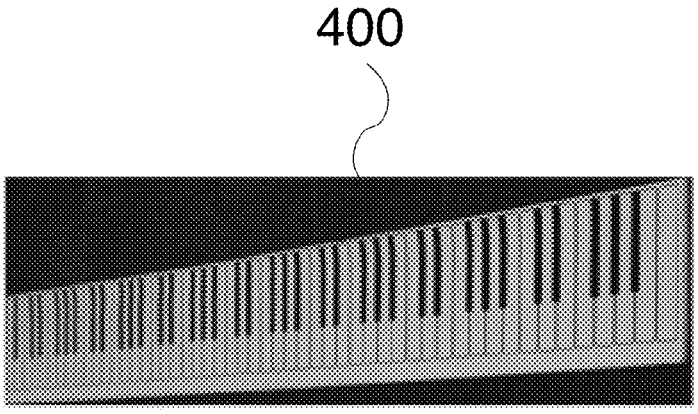
FIG. 4 illustrates one exemplary embodiment, wherein the finger-tracking system is used for playing a paper piano keyboard with 88 keys.

As would be appreciated by persons of ordinary skill in the art, the described finger-tracking system 100 shown in FIG. 1 is capable of fast finger tracking, and may be used in a variety of applications, including applications for playing virtual musical instruments. In one exemplary embodiment, the finger-tracking system 100 is used for playing a paper piano keyboard 400 with 88 keys, as shown in FIG. 4. Whenever the performer puts his finger onto a key indicating that key has been pressed, the position of his finger will be decoded and the corresponding musical note will be played. In one exemplary embodiment, the described finger-tracking system 100 shown in FIG. 1 may be used for teaching piano playing skills to the user. The basis of playing piano is learning the music notation and mapping it onto the keys. With the ability to locate the performer's finger with high resolution, the finger-tracking system 100 can record the sequence of keys that has been pressed and examine performance's "smoothness" and "fluidity" by comparing the recorded data with the desired sequence. Based on the results of the analysis an appropriate feedback may be provided to the user.

In one exemplary embodiment, the described finger-tracking system 100 shown in FIG. 1 may be used for detecting, with high resolution, and recording a sequence of finger movements of a piano master during his play of a musical composition. This sequence may be used as a reference and compared with student's detected finger movements while playing the same composition. Based on the detected differences between reference finger movements and student finger movements, a proper feedback may be provided to the student with an aim to improve the student's piano paying skills.

Figure 5:
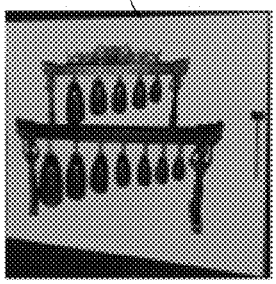
FIG. 5 illustrates one exemplary embodiment, wherein the finger-tracking system is used for playing virtual ancient China bells.

In another exemplary embodiment, the finger-tracking system 100 shown in FIG. 1 is used for playing virtual ancient China bells shown in FIG. 5. By putting the light sensor at different bells, performers would provoke different sound effects. A special property that China bells possess is the ability to produce different musical tones on a single bell, depending on where it is struck. This usually requires performers to practice for a certain amount of time but presents an opportunity for developing interfaces that can facilitate this learning process.

Figure 6:
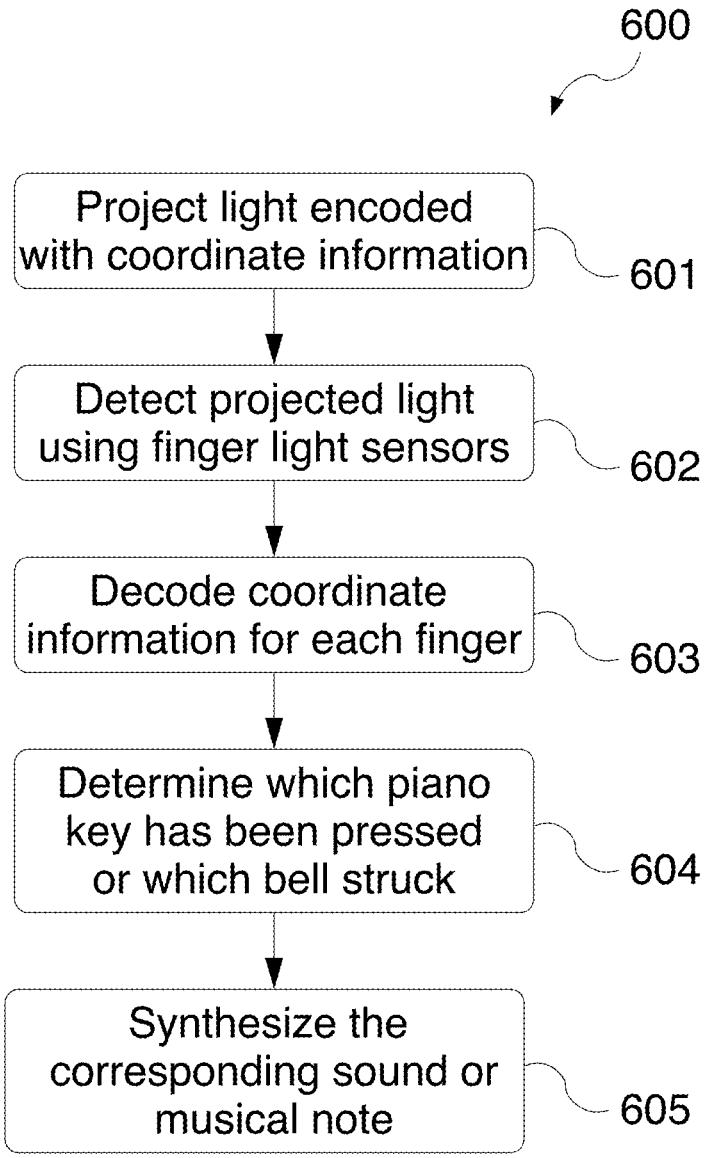
FIG. 6 illustrates an exemplary embodiment of an operating sequence of a process utilizing a finger-tracking system to play a virtual musical instrument.

FIG. 6 illustrates an exemplary embodiment of an operating sequence 600 of a process utilizing a finger-tracking system 100 to play a virtual musical instrument. At step 601, a projector is used to project a temporal projector light signal, encoded, for each pixel of the projector, with information comprising the pixel coordinates of the each pixel of the projector. At step 602, the projected light signal is detected using light sensors 104-113 mounted on the fingers of the user. At step 603, the specially programmed microcontroller decodes the detected projected light signals and determines the positions of each of the user's fingers. At step 604, the desktop computer uses the decoded positions of each of the user's fingers to determine which piano key has been pressed or which Chinese well has been struck by the user. Subsequently, at step 605, the desktop computer synthesizes the sound or note corresponding to pressed key or the struck bell.

As would be appreciated by persons of ordinary skill in the art, an embodiment of the finger-tracking system 100 is different from the vision (color) based system described in Kolesnik, P. 2004. Conducting gesture recognition, analysis and performance system. Master Thesis. McGill University, as does not depend on environmental lighting and requires much less computation resources. The described embodiment is also different from other sensor-based interfaces described, for example, in Ilmonen, T., and Takala, T. 1999. Conductor following with artificial neural networks; Varni, G., Dubus, G., Oksanen, S., Volpe, G., Fabiani, M., Bresin, R., Kleimola, J., Valimaki, V., and Camurri, A. 2012. Interactive sonification of synchronisation of motoric behaviour in social active listening to music with mobile devices. Journal on Multimodal User Interfaces, 5(3-4), 157-173; and Dillon, R., Wong, G., and Ang, R. 2006. Virtual orchestra: An immersive computer game for fun and education. In Proceedings of the 2006 international conference on Game research and development. 215-218; as it does not require alteration existing performer's clothing or equipment and therefore would not be intrusive or affect the performance. Different from both of these two types, the described finger-tracking system 100 does not require complex recognition algorithms, thus it is capable of achieving finger tracking and analyzing user input with high accuracy in real time.

While the embodiments described hereinabove were related to using the finger-tracking system 100 for playing virtual piano and virtual Chinese bells, it would be appreciated by persons of skill in the art that the finger-tracking system 100 may be used for playing a variety of other virtual musical instruments. Therefore, the two described examples should not be interpreted in a limiting sense.

Exemplary Embodiments of Computer System

Figure 7:
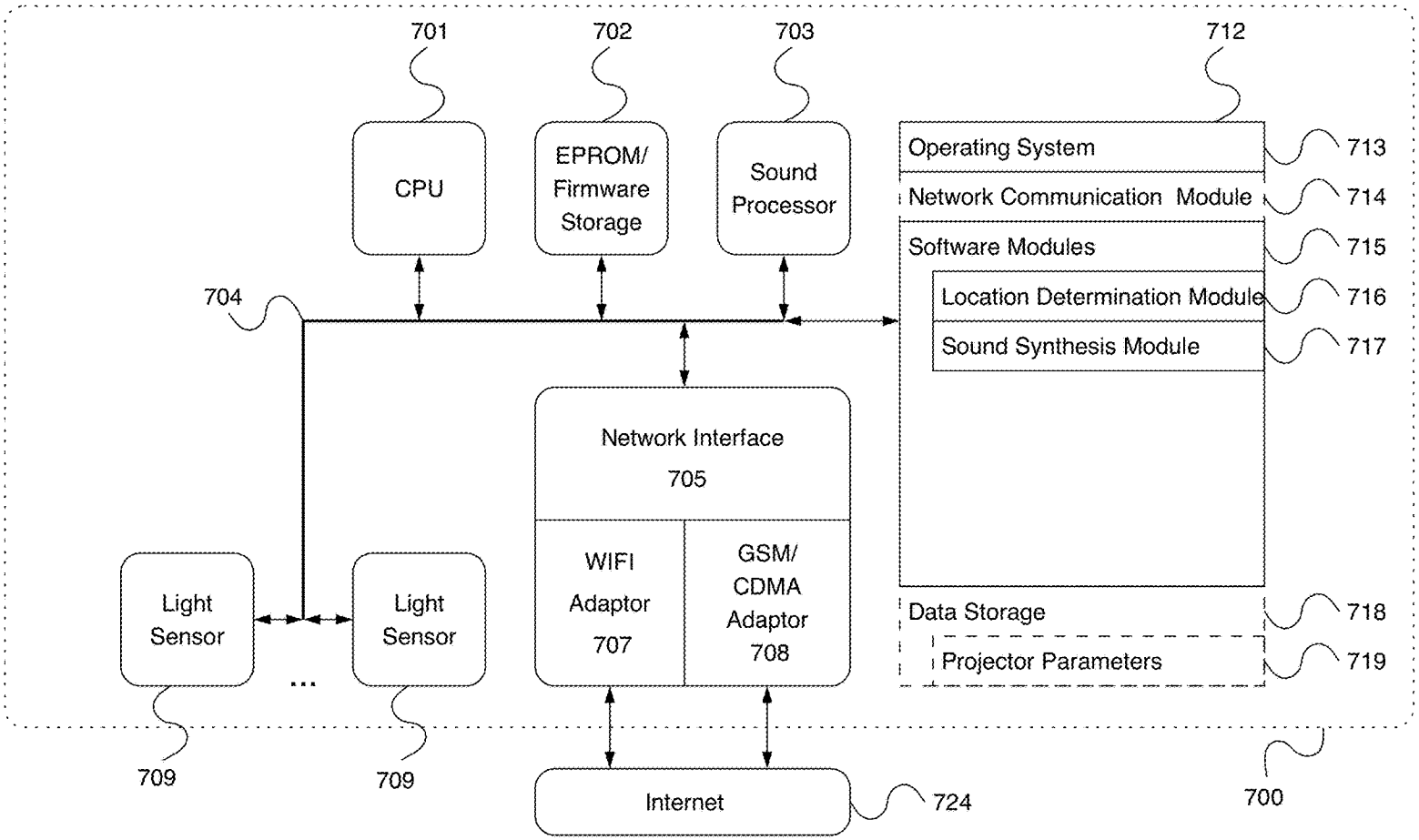
FIG. 7 illustrates an exemplary embodiment of a computer platform, which may be employed as the microcontroller as well as the desktop computer.

FIG. 7 illustrates an exemplary embodiment of a computer platform 700, which may be employed as the microcontroller as well as the desktop computer. In one or more embodiments, the computer platform 700 may be implemented within the form factor of a mobile computing device, well known to persons of skill in the art. In an alternative embodiment, the computer platform 700 may be implemented based on a laptop or a notebook computer. Yet in an alternative embodiment, the computer platform 700 may be a specialized computing system, especially designed for a virtual musical instrument.

The computer platform 700 may include a data bus 704 or other interconnect or communication mechanism for communicating information across and among various hardware components of the computer platform 700, and a central processing unit (CPU or simply processor) 701 coupled with the data bus 704 for processing information and performing other computational and control tasks. The computer platform 700 also includes a memory 712, such as a random access memory (RAM) or other dynamic storage device, coupled to the data bus 704 for storing various information as well as instructions to be executed by the processor 701. The memory 712 may also include persistent storage devices, such as a magnetic disk, optical disk, solid-state flash memory device or other non-volatile solid-state storage devices.

In one or more embodiments, the memory 712 may also be used for storing temporary variables or other intermediate information during execution of instructions by the processor 701. Optionally, computer platform 700 may further include a read only memory (ROM or EPROM) 702 or other static storage device coupled to the data bus 704 for storing static information and instructions for the processor 701, such as firmware necessary for the operation of the computer platform 700, basic input-output system (BIOS), as well as various configuration parameters of the computer platform 700.

In one or more embodiments, the computer platform 700 may additionally incorporate ten luminosity sensors 709 for detecting the coded light signal generated by the projector 101. In one embodiment, the luminosity sensors 709 all have a fast response time to provide for high frequency position detection. In addition, the computer platform 700 may incorporate a sound processor 703 for generating sounds corresponding to the user-pressed virtual piano keys or struck Chinese bell.

In one or more embodiments, the computer platform 700 may additionally include a communication interface, such as a network interface 705 coupled to the data bus 704. The network interface 705 may be configured to establish a connection between the computer platform 700 and the Internet 724 using at least one of WIFI interface 707 and the cellular network (GSM or CDMA) adaptor 708. The network interface 705 may be configured to provide a two-way data communication between the computer platform 700 and the Internet 724. The WIFI interface 707 may operate in compliance with 802.11a, 802.11b, 802.11g and/or 802.11n protocols as well as Bluetooth protocol well known to persons of ordinary skill in the art. In an exemplary implementation, the WIFI interface 707 and the cellular network (GSM or CDMA) adaptor 708 send and receive electrical or electromagnetic signals that carry digital data streams representing various types of information.

In one or more embodiments, the Internet 724 typically provides data communication through one or more subnetworks to other network resources. Thus, the computer platform 700 is capable of accessing a variety of network resources located anywhere on the Internet 724, such as remote media servers, web servers, other content servers as well as other network data storage resources. In one or more embodiments, the computer platform 700 is configured send and receive messages, media and other data, including application program code, through a variety of network(s) including Internet 724 by means of the network interface 705. In the Internet example, when the computer platform 700 acts as a network client, it may request code or data for an application program executing in the computer platform 700. Similarly, it may send various data or computer code to other network resources.

In one or more embodiments, the functionality described herein is implemented by computer platform 700 in response to processor 701 executing one or more sequences of one or more instructions contained in the memory 712. Such instructions may be read into the memory 712 from another computer-readable medium. Execution of the sequences of instructions contained in the memory 712 causes the processor 701 to perform the various process steps described herein. In alternative embodiments, hard-wired circuitry may be used in place of or in combination with software instructions to implement the embodiments of the invention. Thus, embodiments of the invention are not limited to any specific combination of hardware circuitry and software.

The term "computer-readable medium" as used herein refers to any medium that participates in providing instructions to processor 701 for execution. The computer-readable medium is just one example of a machine-readable medium, which may carry instructions for implementing any of the methods and/or techniques described herein. Such a medium may take many forms, including but not limited to, non-volatile media and volatile media.

Common forms of non-transitory computer-readable media include, for example, a floppy disk, a flexible disk, hard disk, magnetic tape, or any other magnetic medium, a CD-ROM, any other optical medium, punchcards, paper-tape, any other physical medium with patterns of holes, a RAM, a PROM, an EPROM, a FLASH-EPROM, a flash drive, a memory card, any other memory chip or cartridge, or any other medium from which a computer can read. Various forms of computer readable media may be involved in carrying one or more sequences of one or more instructions to processor 701 for execution. For example, the instructions may initially be carried on a magnetic disk from a remote computer. Alternatively, a remote computer can load the instructions into its dynamic memory and send the instructions over the Internet 724. Specifically, the computer instructions may be downloaded into the memory 712 of the computer platform 700 from the foresaid remote computer via the Internet 724 using a variety of network data communication protocols well known in the art.

In one or more embodiments, the memory 712 of the computer platform 700 may store any of the following software programs, applications and/or modules:

1. Operating system (OS) 713, which may be a mobile operating system for implementing basic system services and managing various hardware components of the computer platform 700. Exemplary embodiments of the operating system 713 are well known to persons of skill in the art, and may include any now known or later developed mobile operating systems. Additionally provided may be a network communication module 714 for enabling network communications using the network interface 705.

2. Software modules 715 may include, for example, a set of software modules executed by the processor 701 of the computer platform 700, which cause the computer platform 700 to perform certain predetermined functions, such as issue commands to the sound processor 703.

3. Data storage 716 may be used, for example, for storing various parameters, such as various parameters of the projector 101, which are necessary for decoding light pulse sequences received by the light sensors 709. In addition, the data storage 716 may store layout of the piano keyboard, the layout of the Chinese bells as well as layouts of various other virtual musical instruments.

Finally, it should be understood that processes and techniques described herein are not inherently related to any particular apparatus and may be implemented by any suitable combination of components. Further, various types of general purpose devices may be used in accordance with the teachings described herein. It may also prove advantageous to construct specialized apparatus to perform the method steps described herein. The present invention has been described in relation to particular examples, which are intended in all respects to be illustrative rather than restrictive. Those skilled in the art will appreciate that many different combinations of hardware, software, and firmware will be suitable for practicing the present invention. For example, the described software may be implemented in a wide variety of programming or scripting languages, such as Assembler, C/C++, Objective-C, perl, shell, PHP, Java, as well as any now known or later developed programming or scripting language.

Moreover, other implementations of the invention will be apparent to those skilled in the art from consideration of the specification and practice of the invention disclosed herein. Various aspects and/or components of the described embodiments may be used singly or in any combination in the finger-tracking systems and methods for virtual instruments playback. It is intended that the specification and examples be considered as exemplary only, with a true scope and spirit of the invention being indicated by the following claims.

What is claimed is:

1. A finger-tracking system comprising:

a. a projector configured to project a temporal projector light signal, wherein the temporal projector light signal is encoded, for each pixel of the projector, with an information segment comprising the pixel coordinates of the each pixel of the projector;

b. a plurality of light sensors, each of the plurality of light sensors being attached to a finger of a user, wherein each of the plurality of light sensors is configured to detect the temporal projector light signal and generate a sensor signal; and c. a processing unit operatively coupled to each of the plurality of light sensors and configured to receive the sensor signal from each of the plurality of light sensors, to determine a location information of each finger of the user and to issue a command based on the detected location of at least one finger of the user.

2. The finger-tracking system of claim 1, wherein the processing unit determines the location information of each finger of the user by identifying a projector pixel corresponding to the sensor signal from a light sensor attached to the corresponding finger of the user.

3. The finger-tracking system of claim 1, wherein the issued command causes a sound or a musical note to be synthesized.

4. The finger-tracking system of claim 1, wherein the location information of each finger of the user is determined in relation to an image of a piano keyboard comprising a plurality of piano keys.

5. The finger-tracking system of claim 4, wherein the processing unit uses the location information of each finger of the user to determine which piano key of the plurality of piano keys has been pressed.

6. The finger-tracking system of claim 5, wherein the processing unit causes a sound or a musical note corresponding to pressed piano key to be synthesized.

7. The finger-tracking system of claim 5, wherein the processing unit causes a sequence of pressed piano keys to be recorded.

8. The finger-tracking system of claim 7, wherein the recorded sequence of pressed piano keys is compared with a reference sequence to determine a difference and a feedback to the user is generated based on the determined difference.

9. The finger-tracking system of claim 1, wherein the location information of each finger of the user is determined in relation to an image of a plurality of Chinese bells.

10. The finger-tracking system of claim 9, wherein the processing unit uses the location information of each finger of the user to determine which bell of the plurality of Chinese bells has been struck.

11. The finger-tracking system of claim 10, wherein the processing unit causes a sound or a musical note corresponding to the struck bell to be synthesized.

12. The finger-tracking system of claim 1, wherein the temporal projector light signal projected by the project comprises a plurality of sequential light pulses encoding pixel coordinates of the each pixel of the projector.

13. The finger-tracking system of claim 1, further comprising a computer system comprising a display unit and operatively coupled with the processing unit and configured to receive from the processing unit the determined location information of each finger of the user and to display the received location information of each finger of the user on the display unit.

14. The finger-tracking system of claim 13, wherein the location information of each finger of the user is displayed on the display unit in a different color.

15. The finger-tracking system of claim 1, wherein the projector is a DLP projector.

16. A method for tracking fingers of a user, the method comprising:

a. using a projector to project a temporal projector light signal, wherein the temporal projector light signal is encoded, for each pixel of the projector, with an information segment comprising the pixel coordinates of the each pixel of the projector;

b. detecting the temporal projector light signal using a plurality of light sensors, each of the plurality of light sensors being attached to a finger of a user, wherein each of the plurality of light sensors is configured to detect the temporal projector light signal and generate a sensor signal; and c. using a processing unit operatively coupled to each of the plurality of light sensors to receive the sensor signal from each of the plurality of light sensors, to determine a location information of each finger of the user and to issue a command based on the detected location of at least one finger of the user.

17. The method for tracking fingers of a user of claim 16, wherein the processing unit determines the location information of each finger of the user by identifying a projector pixel corresponding to the sensor signal from a light sensor attached to the corresponding finger of the user.

18. The method for tracking fingers of a user of claim 16, wherein the issued command causes a sound or a musical note to be synthesized.

19. The method for tracking fingers of a user of claim 16, wherein the location information of each finger of the user is determined in relation to an image of a piano keyboard comprising a plurality of piano keys.

20. A computer-readable medium embodying a set of instructions implementing a method for tracking fingers of a user, the method comprising:

a. using a projector to project a temporal projector light signal, wherein the temporal projector light signal is encoded, for each pixel of the projector, with an information segment comprising the pixel coordinates of the each pixel of the projector;

b. detecting the temporal projector light signal using a plurality of light sensors, each of the plurality of light sensors being attached to a finger of a user, wherein each of the plurality of light sensors is configured to detect the temporal projector light signal and generate a sensor signal; and c. using a processing unit operatively coupled to each of the plurality of light sensors to receive the sensor signal from each of the plurality of light sensors, to determine a location information of each finger of the user and to issue a command based on the detected location of at least one finger of the user.

* * * * *